United States Patent [19]

Clarke et al.

[11] Patent Number: 4,945,652

[45] Date of Patent: Aug. 7, 1990

[54] CONTROLLED STEAM DRYING OF VENEER SHEETS

[75] Inventors: Michael R. Clarke, North Vancouver; Gary E. Troughton, Vancouver; Donald C. Walser, Surrey, all of Canada

[73] Assignee: Forintek Canada Corporation, Vancouver, Canada

[21] Appl. No.: 340,077

[22] Filed: Apr. 18, 1989

[51] Int. Cl.[5] ..... F26B 7/00

[52] U.S. Cl. ..... 34/12; 34/51; 34/53

[58] Field of Search ..... 34/9.5, 13.4, 13.8, 34/16.5, 95, 12, 51, 53

[56] References Cited

U.S. PATENT DOCUMENTS

| | | | |
|---|---|---|---|
| 3,280,237 | 10/1966 | Corbin et al. | 264/109 |
| 3,891,738 | 6/1975 | Shen | 264/101 |
| 4,162,877 | 7/1979 | Nyberg | 425/84 |
| 4,393,019 | 7/1983 | Geimer | 264/83 |
| 4,612,802 | 9/1986 | Clarke et al. | 73/73 |
| 4,655,869 | 4/1987 | Tellman et al. | 156/252 |
| 4,790,360 | 12/1988 | Clarke et al. | 144/213 |

OTHER PUBLICATIONS

Karl Walter—The Steam Press: It Adds a New Dimension to Panel Potential—Wood Based Panels International—Nov. 1988—pp. 36–38.

Brookhyser et al.—Carousel 'Irons' Veneer Dry—Wood and Wood Products—May 1980—pp. 47–48.

*Primary Examiner*—Henry A. Bennet

*Attorney, Agent, or Firm*—Fetherstonhaugh & Co.

[57] ABSTRACT

A system of drying veneer sheets for manufacturing wood products such as plywood, measures the moisture content of the sheets and controls drying to a predetermined moisture content. By drying veneer sheets to the predetermined moisture content, avoids excessive drying to ensure all sheets are below the 11% moisture content level. A process of drying comprises incising a veneer sheet, sensing the moisture content of the incised veneer sheet, steam drying the sheet under pressure and controlling the drying based on the sensed moisture content of the veneer sheet, to dry the sheet to the predetermined moisture content.

17 Claims, 6 Drawing Sheets

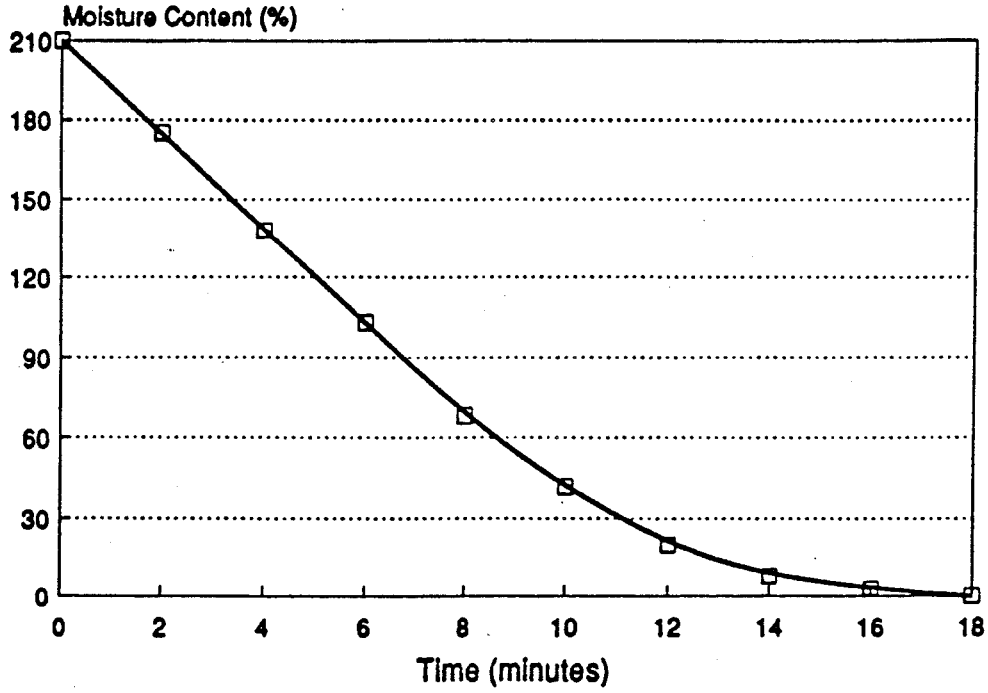
FIG. 2. Oven drying Curve at 180°C for incised 1/8 inch spruce veneer
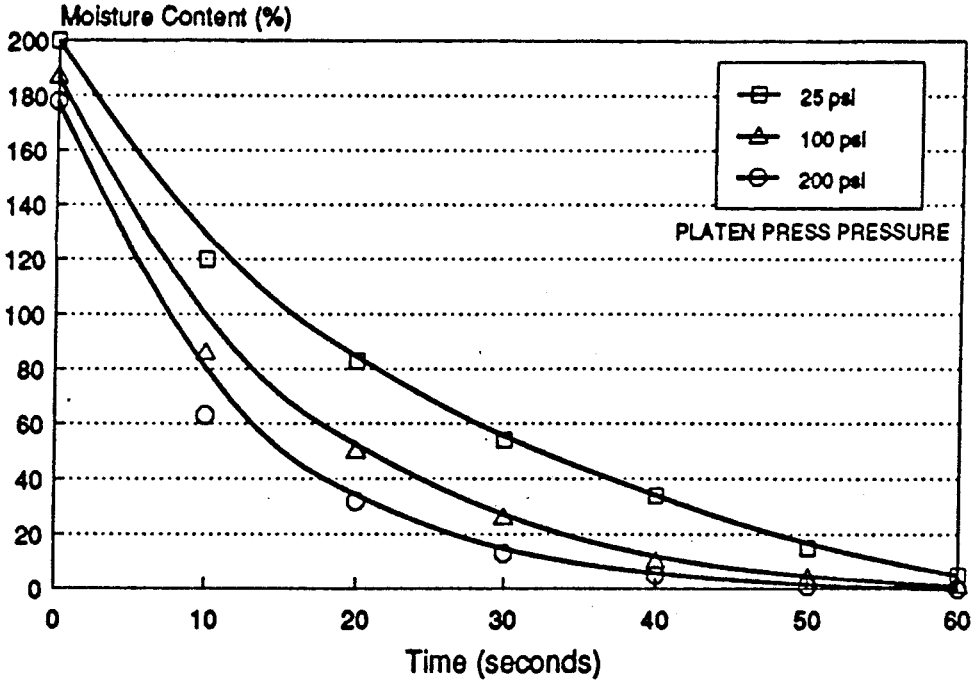
FIG. 3. Steam-press drying curves for incised 1/8 inch spruce veneer

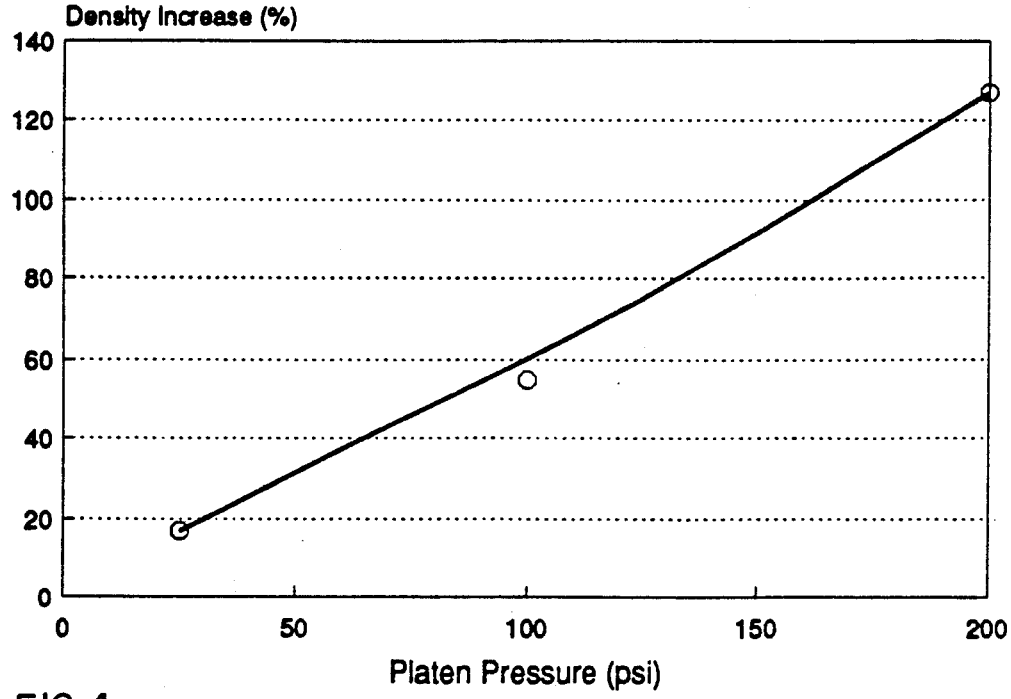
FIG.4. Relationship between % density increase and platen pressure for incised spruce veneer (steam-press dried)
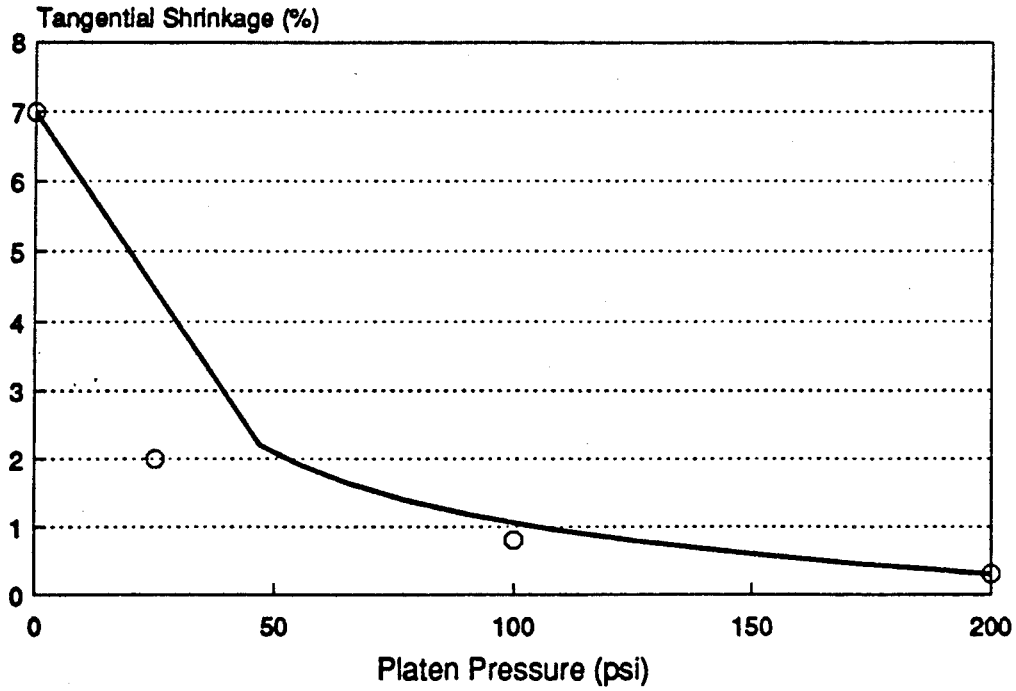
FIG.5. Relationship between tangential shrinkage and platen pressure for incised spruce veneer (steam-press dried)

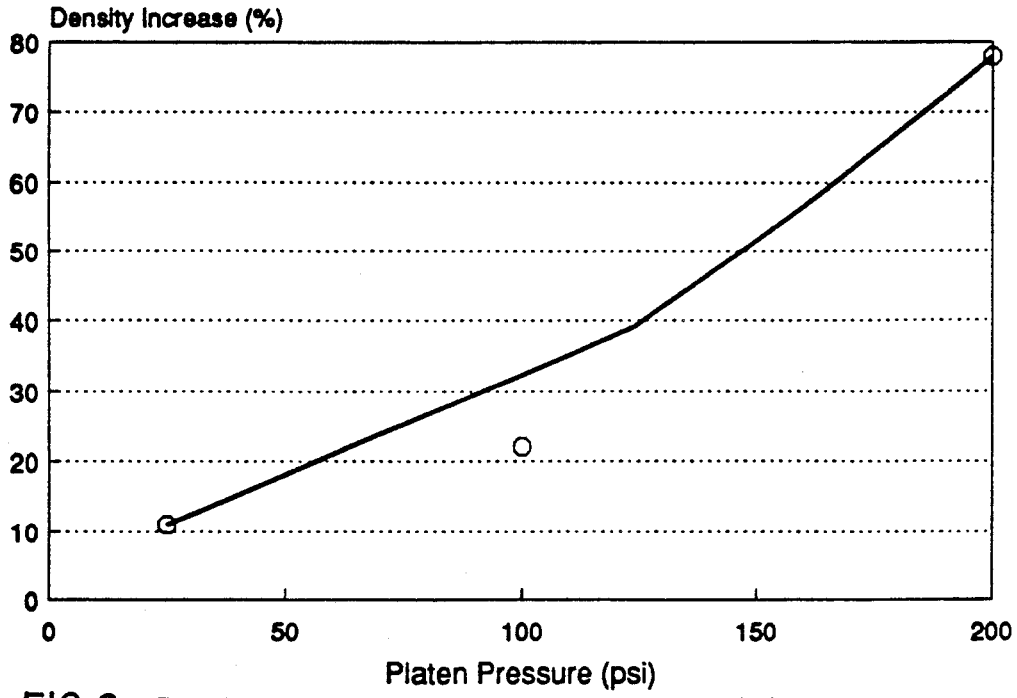
FIG. 6. Relationship between % density increase and platen pressure for incised pine veneer (steam-press dried)
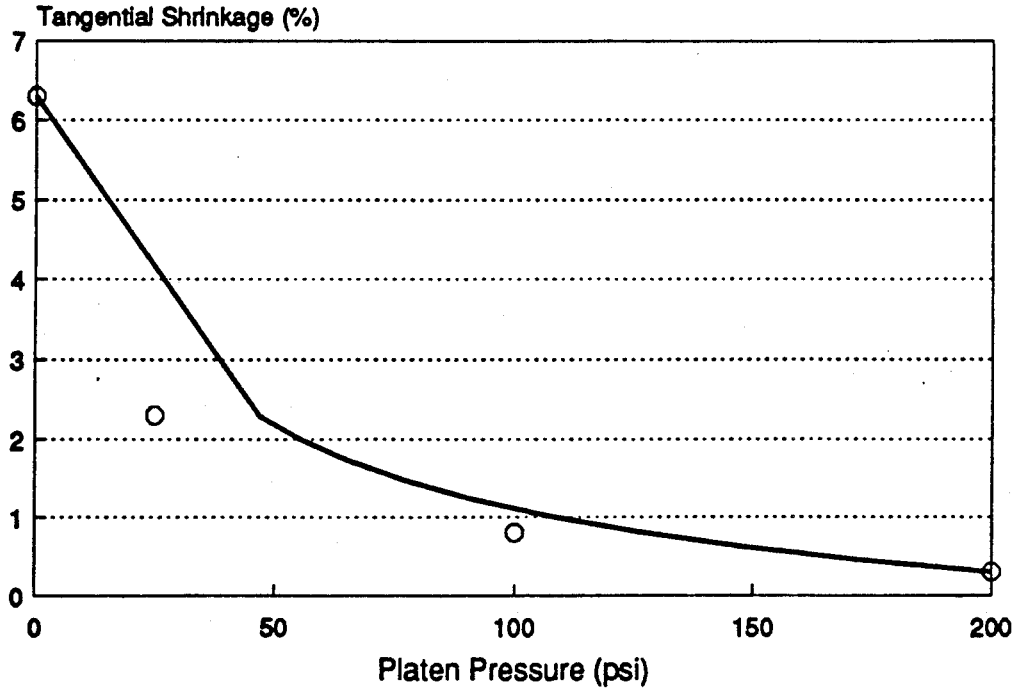
FIG. 7. Relationship between tangential shrinkage and platen pressure for incised pine veneer (steam-press dried)

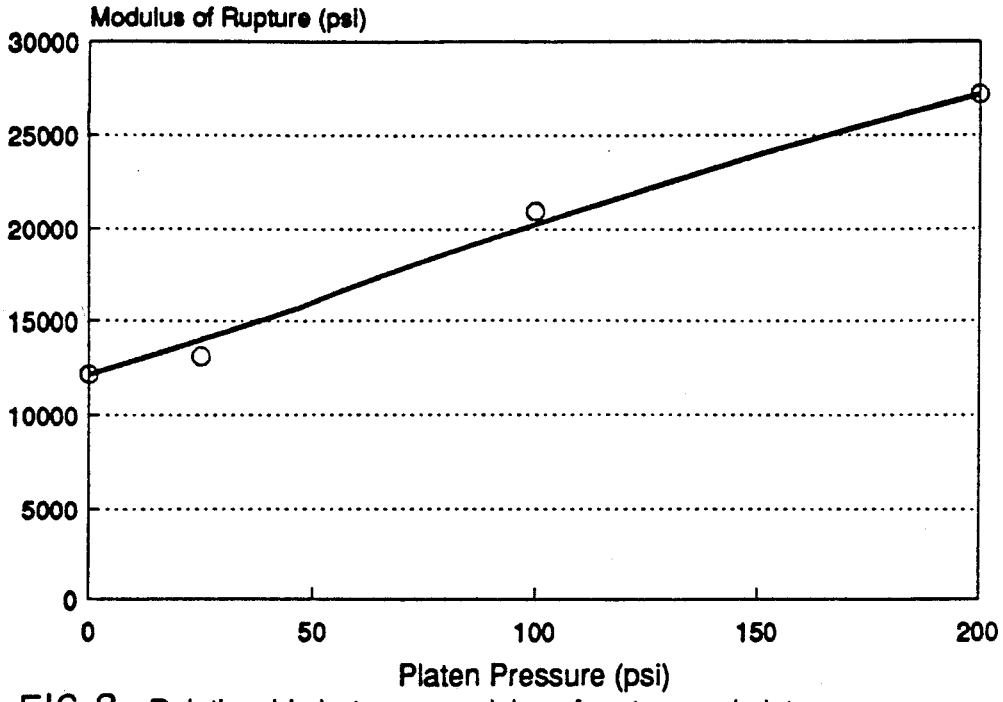
FIG. 8. Relationship between modulus of rupture and platen pressure for incised spruce veneer (steam-press dried)
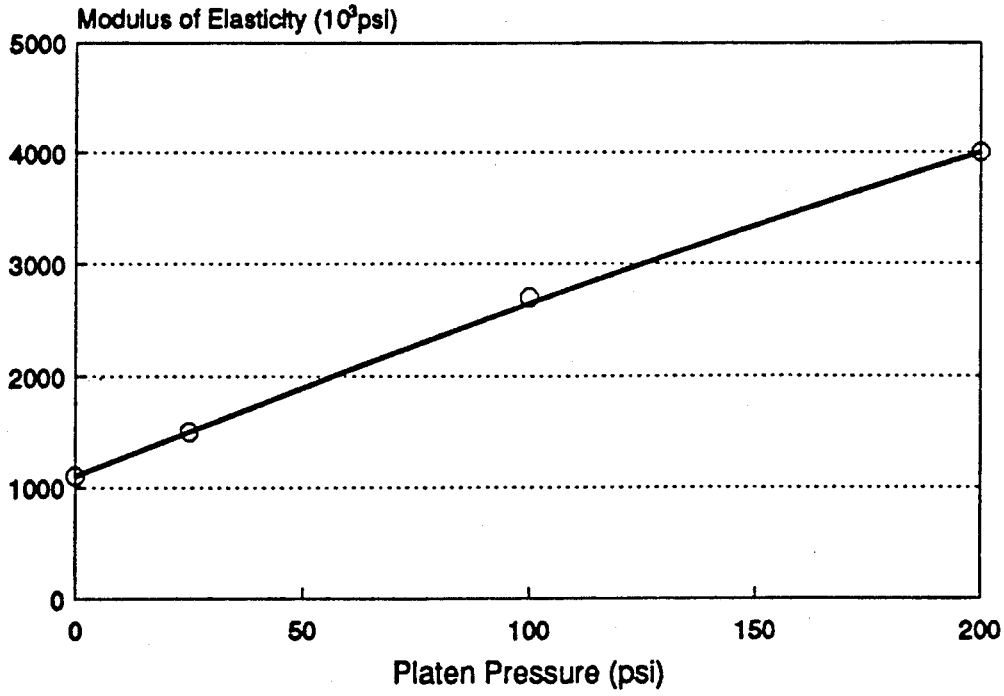
FIG. 9. Relationship between modulus of elasticity and platen pressure for incised spruce veneer (steam-press dried)

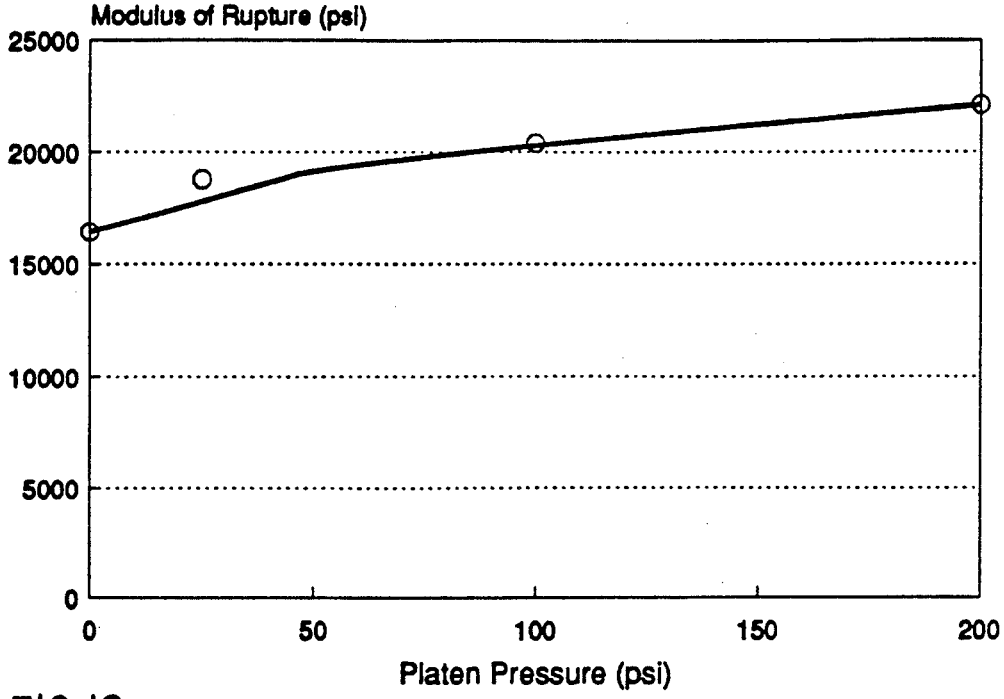
FIG. 10. Relationship between modulus of rupture and platen pressure for incised pine veneer (steam-press dried)
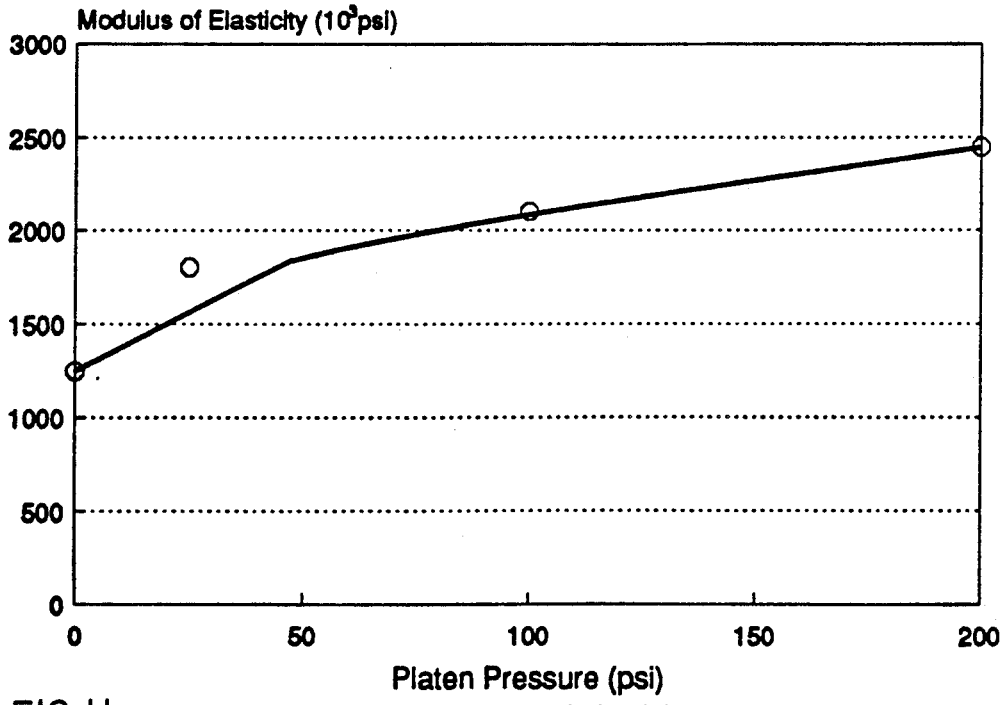
FIG. 11. Relationship between modulus of elasticity and platen pressure for incised pine veneer (steam-press dried)

CONTROLLED STEAM DRYING OF VENEER SHEETS

The present invention relates to drying veneer sheets in preparation for manufacturing wood products such as plywood, and more specifically to steam drying unseasoned veneer sheets to provide a predetermined moisture content of the dried sheet regardless of the initial moisture content of the veneer.

BACKGROUND OF THE INVENTION

In the preparation of plywood and other board products made with veneer and phenol adhesives, the veneer is generally dried in an oven in order to lower the moisture content below 10%, otherwise when wet veneer, that is to say veneer with a moisture content greater than 11%, is hot pressed into plywood blows can occur in the panels due to steam formed by the moisture in the wood and consequently the adhesive does not bind the layers together. This results in the plywood panel not meeting the necessary strength requirements.

Because many sheets of veneer are placed in a single oven, they all receive the same drying time and temperature. However, it is known that sheets of green veneer when initially placed in a dryer do not have all the same moisture content. In fact there is quite a range of moisture content between veneer sheets and as a result the dried sheets have a range of moisture content, varying from bone dry veneer sheets to those having a moisture content in the order of 15%. The reasons for different moisture content of green veneer are many, and in one case include the fact that sapwood veneer has a higher moisture content than heartwood veneer.

If the veneer is over dried, that is to say if heating is continued after the moisture content is down to 0, then it is found that the wood veneer surface binds poorly with phenol formaldehyde resins.

When veneer sheets are dried below 10% moisture content, buckling or deformation can occur in the sheets, making the sheet hard to handle when being placed in a plywood press. The preferred range of moisture content for veneer sheets is between about 10 and 15%, but it is difficult to achieve this range in oven dried veneer. In most commercial veneer sheet production operations, the best range that can be economically achieved is plus or minus 5% moisture content and this results in a range of from 5% to 15% moisture content, although in most mills veneer sheets are dried down to 1% moisture content. As can be appreciated, drying veneer sheets to these low moisture content figures requires a lot of heating energy, and the dry sheets are often buckled or deformed which makes them more difficult to handle.

SUMMARY OF THE INVENTION

It is an aim of the present invention to provide a drying system to reduce the wide distribution of veneer sheet moisture content presently achieved in oven drying and provide veneer sheets which have a substantially uniform moisture content. It is a further aim to provide a process to dry veneer sheets individually and to control the moisture content of each sheet. The drying process is far shorter than present oven drying systems and reduces costs of heating.

The present invention provides a process of drying veneer sheets individually, wherein the sheet is first incised, the moisture content of the sheet is measured and the sheet is heated in the presence of a pressurized heat transfer agent such as steam or hot air. The heating step is controlled based on the initial moisture content so that the end moisture content of the sheet is at a predetermined figure regardless of the initial moisture content. Thus each veneer sheet, regardless of its initial moisture content, ends up by having substantially the same moisture content for use in a plywood press, or in production of other wood panel products.

It is known that wood tenderizing, or incising of veneer sheets improves the drying rate. One example of a wood incisor is disclosed in U.S. Pat. No. 4,790,360 to Clarke et al. The determination of moisture content in a veneer sheet may be carried out by the method and apparatus disclosed in U.S. Pat. No. 4,612,802 to Clarke et al., wherein an initial temperature of a surface is measured, followed by heating the surface and then measuring the temperature of the same surface directly after the heating step. The two temperatures are compared and utilizing these figures, the moisture content of the wood surface is determined.

The present invention provides a process for drying wet veneer sheets to a predetermined moisture content, comprising the steps of incising a veneer sheet, sensing moisture content of the incised veneer sheet, steam drying the veneer sheet, and controlling the drying, based on the sensed moisture content of the veneer sheet, to the predetermined moisture content.

The present invention also provides an apparatus for drying wet veneer sheets to a predetermined moisture content comprising an incising means for incising a veneer sheet, moisture sensing means for determining moisture content of the incised veneer sheet and producing a signal corresponding to the moisture content, steam drying press for steam drying the incised sheet with a control system for controlled drying based on the signal from the moisture measuring means to dry the sheet to the predetermined moisture content.

BRIEF DESCRIPTION OF THE DRAWINGS

In drawings which illustrate the embodiments of the invention:

FIG. 2 is a graph showing the oven drying curve for incised ⅛ inch spruce veneer oven dried veneer in a present day veneer drying system;

FIG. 3 is a graph showing the drying curves for incised spruce veneer sheets in a steam press according to the present invention with different platen pressures;

FIG. 4 is a graph showing the relationship between percentage density increase and platen pressure for incised spruce veneer sheets dried according to the present invention;

FIG. 5 is a graph showing the relationship between tangential shrinkage and platen pressure for incised spruce veneer sheets dried according to the present invention;

FIG. 6 is a graph showing the relationship between percentage density increase and platen pressure for incised pine veneer sheets dried according to the present invention.

FIG. 7 is a graph showing the relationship between tangential shrinkage and platen pressure for incised pine veneer sheets dried according to the present invention.

FIG. 8 is a graph showing the relationship between modulus of rupture and platen pressure for incised spruce veneer sheets dried according to the present invention.

FIG. 9 is a graph showing the relationship between modulus of elasticity and platen pressure for incised spruce veneer sheets dried according to the present invention.

FIG. 10 is a graph showing the relationship between modulus of rupture and platen pressure for incised pine veneer sheets dried according to the present invention.

FIG. 11 is a graph showing the relationship between modulus of elasticity and platen pressure for incised pine veneer sheets dried according to the present invention.

DESCRIPTION OF PREFERRED EMBODIMENT

Figure 1:
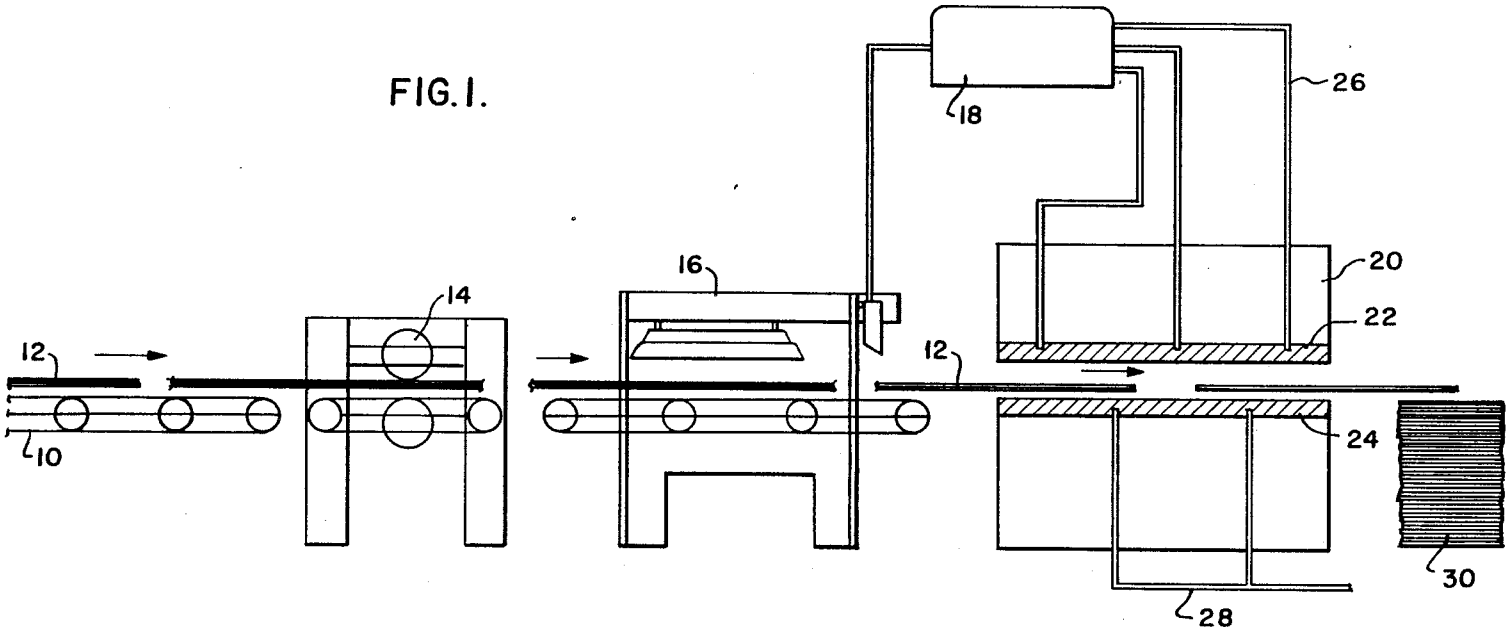
FIG. 1 is a schematic side view showing one embodiment of an apparatus for controlled steam drying of veneer sheets.

A controlled steam press drying system is illustrated in FIG. 1 wherein a conveyor 10 feeds individual wet veneer sheets 12 between a pair of incisor rolls 14 followed by a moisture sensor 16. The moisture sensor 16 is of the type disclosed in U.S. Pat. No. 4,612,802 and produces a signal representative of the moisture content of the veneer sheet which is passed to a controller 18. The incised veneer sheet 12 then passes to a steam press 20 having a top paten 22 and a bottom platen 24. Both the top platen 22 and the bottom platen 24 are preheated prior to the entry of an incised veneer sheet. Super heated steam flows from steam lines 26 through the top platen 22 and the veneer sheet 12 between the platens, to the bottom platen 24 and passes to an exit steam line 28. The controller 18 controls the press cycle, including the steam flow, and is determined from the input from the moisture sensor 16 indicating the moisture content of the veneer sheet 12 prior to insertion into the press 20. The dried veneer sheet 12 is then placed in a stack 30 in preparation for further processing in a plywood press or the like.

Different patterns of incisions on a veneer sheet may be applied. The incising rolls are similar to those shown in U.S. Pat. No. 4,790,360, however other types of incising devices may be used. Tests were carried out on permeability of an incised veneer sheet, and it was found that whether it was juvenile or mature veneer, the air flow was substantially the same. A typically air flow reading before and after drying measured at 25 psi air pressure was 350 and 250 standard cubic feet per hour respectively.

A number of variables were used in controlling the steam press based on the moisture content of the veneer sheet. The resident time for the veneer in the press was the first factor applied. The steam, which is super heated, has two variables, pressure and temperature. Either one of these affects the drying of the veneer sheet. The platen pressure in the press also affects the drying of the veneer sheet, higher platen pressures result in increased modulus of rupture and modulus of elasticity of the veneer as will be shown hereafter.

The moisture sensor senses the moisture content of the veneer sheet while moving on the conveyor 10. The moisture content sensor can be arranged to measure areas of moisture content at different locations on the sheet.

In the press itself it is preferred that the platens are preheated and kept at a substantially constantly temperature. Control of the press may be by any one or more of the four variable steps, namely residence time in the press, pressure of the platens and temperature and pressure of the super heated steam.

EXAMPLES:

In order to evaluate the steam press drying on the properties of Western White Spruce and Lodgepole Pine, unseasoned sheets of 2×4 ft. veneer were incised, and then cut into 10½×13 inch samples.

For the steam press drying experiments, the platen temperature was maintained at 200 degrees Celsius, and the super heated steam was injected at 40 psi and 260 degrees Celsius. The super heated steam was injected through the upper platen 22 and exited through the bottom platen 24 and the bottom steam outlet 28. Platen pressures of 25, 100 and 200 psi were used in the drying experiments. One inch wide specimens were cut from samples that had been steam dried and tested using an Instron machine. Modulus of rupture and modulus of elasticity were calculated for different platen pressures.

FIG. 2 represents samples of incised spruce veneer dried to 0% M.C. using conventional oven heating. The time to dry the veneer to 0% M.C. is in the order of 18 minutes. FIG. 3 illustrates incised spruce veneer dried in the steam press according to the present invention for different platen pressures. As can be seen, the drying time in the steam press is in the order of 1 minute or less as compared to oven drying time. The drying time was reduced in steam pressing with increase in platen pressure. In general, the steam-press drying of incised spruce veneer was 20 times faster than conventional oven drying. Further, the steam-press dried veneer was flatter than the oven-dried veneer. This would help reduce veneer breakage during processing in the plywood mills.

FIGS. 4 and 6 show the percentage density increase with increasing platen pressure in the steam-press drying experiments for incised spruce and pine veneer respectively. This density increase is reflected in greatly increased veneer strength and stiffness properties.

FIGS. 5 and 7 show the relationship between tangential shrinkage and platen pressure for incised spruce and pine veneer respectively. In these figures, the tangential shrinkage value at 0 psi platen pressure was measured for the conventional oven-dried veneer sample. Steam-press drying of both incised spruce and pine veneer caused a substantial reduction (4 to 5%) in tangential shrinkage even at the lowest platen pressure of 25 psi. This reduction in tangential shrinkage would help improve the veneer yield.

FIG. 8 shows the relationship between modulus of rupture (strength) and platen pressure for steam press dried incised spruce veneer. The value at 0 psi was measured for the oven-dried incised spruce veneer. The modulus of rupture shows a sharp increase with increasing platen pressure. The modulus of rupture for the oven-dried incised spruce veneer was 12,200 psi compared to the modulus of rupture for the steam-press dried (200 psi platen pressure) incised spruce veneer of 27,200 psi. Thus the strength of the incised spruce veneer has more than doubled.

FIG. 9 shows the relationship between modulus of elasticity (stiffness) and platen pressure for the steam-press dried incised spruce veneer. Again the value at 0 psi was measured for the oven-dried incised spruce veneer. The modulus of elasticity showed a much more rapid increase than the modulus of rupture with increasing platen pressure. The modulus of elasticity for the oven-dried spruce veneer was 1,100,000 psi compared to the modulus of elasticity for the steam-press dried (200 psi platen pressure) incised spruce veneer of 4,000,000 psi. The stiffness of the incised spruce veneer has increased by a factor of 3.6.

FIG. 10 shows the relationship between modulus of rupture and platen pressure for steam-press dried incised pine veneer. The value at 0 psi represents the oven-dried incised pine veneer. The modulus of rupture for the oven-dried pine veneer was 16,500 psi compared to the modulus of rupture for the steam-press dried (200 psi platen pressure) incised pine veneer of 22,100 psi. The incised pine veneer showed a slower gain in strength than incised spruce veneer with increasing platen pressure and this is reflected in the smaller density increase for the incised pine veneer (FIG. 6) compared to incised spruce veneer (FIG. 4).

FIG. 11 shows the relationship between modulus of elasticity and platen pressure for the steam-press dried incised pine veneer. The value at 0 psi represents the oven-dried incised pine veneer. Similar to the incised spruce veneer, the modulus of elasticity (stiffness) showed a much more rapid increase than the modulus of rupture (strength) with increasing platen pressure. The modulus of elasticity for the oven-dried pine veneer was 1,250,000 psi compared to the modulus of elasticity for the steam-press dried (200 psi platen pressure) incised pine veneer of 2,450,000 psi. The stiffness of the incised pine veneer has about doubled.

While the examples illustrate tests carried out wherein veneer samples are dried to specific moisture contents. It will be seen that the starting moisture content of the samples was different and reference is made specifically to FIG. 3. Utilizing a number of tests, it is apparent that varying the residence time, platen pressure or indeed the temperature and pressure of the super heated steam or combinations of any or all of these, may be used to control the specific heating in the steam press required for a sheet of veneer having a particularly measured moisture content, and to lower that moisture content to a predetermined value.

As an example of a commercial veneer drying operation, the signal from the moisture sensor controls the residence time the unseasoned incised veneer is in the steam press. Typical fixed settings for the preheated platen press, platen pressure, temperature and pressure of the super heated steam would be 200° C., 25 psi, 260° C. and 80 psi respectively.

Various changes may be made to the process and apparatus disclosed herein without departing from the scope of the present invention which is limited only by the following claims.

The embodiments of the invention in which an exclusive property or privilege is claimed are defined as follows:

1. A process for drying unseasoned veneer sheets to a predetermined moisture content, comprising the steps of incising a veneer sheet, sensing moisture content of the incised veneer sheet, steam drying the veneer sheet under pressure, and controlling the drying, based on the sensed moisture content of the veneer sheet, to dry the sheet to the predetermined moisture content.

2. The drying process according to claim 1 wherein the veneer sheet advances on a conveyor means.

3. The drying process according to claim 2 wherein the moisture content of the incised veneer sheet is determined while the sheet is moving.

4. The drying process according to claim 3 wherein the moisture content of the incised veneer sheet is determined at a plurality of locations on the sheet, and the drying is controlled based on the highest moisture content determined.

5. The drying process according to claim 1 wherein the steam drying occurs in a press and super heated steam is forced through the incised veneer sheet from one platen to the other platen of the press.

6. The drying process according to claim 5 wherein the steam drying is controlled by controlling the temperature and the pressure of the super heated steam passing through the veneer sheet.

7. The drying process according to claim 1 wherein the steam drying is controlled by controlling the time the veneer sheet is steam dried.

8. The drying process according to claim 5 wherein the steam drying is controlled by controlling the resident time the veneer sheet remains in the press.

9. The drying process according to claim 5 wherein the steam drying is controlled by controlling the pressure in the press.

10. The drying process according to claim 5 wherein the steam drying is controlled by at least one of the following steps, controlling the resident time the veneer sheet remains in the press, controlling the pressure of the super heated steam, controlling the pressure of the super heated steam, and controlling the pressure in the press.

11. The process according to claim 5 wherein the press platens are preheated.

12. An apparatus for drying wet veneer sheets to a predetermined moisture content comprising:

an incising means for incising a veneer sheet, moisture sensing means for determining moisture content of the incised veneer sheet and producing a signal corresponding to the moisture content, steam drying press for steam drying the incised sheet with a control system for controlled drying based on the signal from the moisture measuring means, to dry the sheet to the predetermined moisture content.

13. The apparatus according to claim 12 wherein the incising means comprises a pair of incising rolls through which the veneer sheet passes.

14. The apparatus according to claim 12 wherein the moisture sensing means is mounted above a conveyor means conveying the incised veneer sheet, the sensing means takes a number of readings of moisture content at different locations on the sheet.

15. The apparatus according to claim 12 wherein the press has a top platen and a bottom platen, and super heated steam is forced from the top platen through an incised veneer sheet to the bottom platen.

16. The apparatus according to claim 15 wherein the control system includes at least one:

means to control temperature of super heated steam to the press, means to control pressure of super heated steam to the press, means to control the pressure of the press, and means to control resident time for a veneer sheet in the press.

17. The apparatus according to claim 15 wherein the press platens are preheated.

* * * * *